US009382781B2

(12) United States Patent
Allen et al.

(10) Patent No.: US 9,382,781 B2
(45) Date of Patent: Jul. 5, 2016

(54) COMPLETION SYSTEM FOR ACCOMODATING LARGER SCREEN ASSEMBLIES

(71) Applicants: Jason Allen, Houston, TX (US); Robert O'Brien, Katy, TX (US); Mark Adam, Houston, TX (US)

(72) Inventors: Jason Allen, Houston, TX (US); Robert O'Brien, Katy, TX (US); Mark Adam, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 415 days.

(21) Appl. No.: 13/892,444

(22) Filed: May 13, 2013

(65) Prior Publication Data

US 2014/0166284 A1 Jun. 19, 2014

Related U.S. Application Data

(60) Provisional application No. 61/739,606, filed on Dec. 19, 2012.

(51) Int. Cl.

| | |
|---|---|
| ***E21B 33/14*** | (2006.01) |
| ***E21B 43/00*** | (2006.01) |
| ***E21B 43/08*** | (2006.01) |
| ***E21B 43/10*** | (2006.01) |
| ***E21B 43/11*** | (2006.01) |

(52) U.S. Cl.

CPC ..... *E21B 43/103* (2013.01); *E21B 43/08* (2013.01); *E21B 43/11* (2013.01)

(58) Field of Classification Search

CPC ... E21B 43/103; E21B 43/106; E21B 43/105; E21B 43/108; E21B 43/08; E21B 43/086; E21B 43/11

See application file for complete search history.

(56) References Cited

U.S. PATENT DOCUMENTS

| | | | | |
|---|---|---|---|---|
| 4,858,691 | A * | 8/1989 | Ilfrey et al. | 166/278 |
| 5,390,742 | A * | 2/1995 | Dines et al. | 166/297 |
| 7,055,598 | B2 * | 6/2006 | Ross et al. | 166/236 |
| 7,225,523 | B2 * | 6/2007 | Metcalfe | 29/507 |
| 7,543,637 | B2 * | 6/2009 | Green et al. | 166/254.1 |
| 7,681,648 | B2 | 3/2010 | Ring | |
| 8,215,409 | B2 * | 7/2012 | Adam et al. | 166/384 |
| 8,511,380 | B2 * | 8/2013 | Guignard et al. | 166/278 |
| 2004/0055758 | A1 * | 3/2004 | Brezinski et al. | 166/384 |
| 2004/0149431 | A1 * | 8/2004 | Wylie et al. | 166/242.1 |

(Continued)

OTHER PUBLICATIONS

International Search Report and Written Opinion, International Application No. PCT/US2013/069154, Mailed Feb. 17, 2014, Korean Intellectual Property Office; International Search Report and Written Opinion, 8 pages.

(Continued)

*Primary Examiner* — Daniel P Stephenson
(74) *Attorney, Agent, or Firm* — Cantor Colburn LLP

(57) ABSTRACT

A completion system, including a tubular string initially having an substantially constant first dimension and configured to include at least one unexpanded portion having the first dimension and at least one expanded portion having a second dimension larger than the first dimension. The tubular string has at least one opening therein formed at the at least one expanded portion. At least one screen assembly is included having a third dimension and positioned radially adjacent the at least one expanded portion. A radial clearance is formed between the outer dimension of the at least one screen assembly and the second internal dimension of the at least one second portion of the outer tubular string. A method of completing a borehole is also included.

17 Claims, 2 Drawing Sheets

(56) References Cited

U.S. PATENT DOCUMENTS

| | | | | |
|---|---|---|---|---|
| 2004/0216889 | A1 | 11/2004 | Fraser, III | |
| 2004/0244979 | A1* | 12/2004 | Adam et al. | 166/297 |
| 2004/0251033 | A1* | 12/2004 | Cameron et al. | 166/382 |
| 2004/0261994 | A1* | 12/2004 | Nguyen et al. | 166/278 |
| 2005/0045342 | A1* | 3/2005 | Luke et al. | 166/384 |
| 2006/0090903 | A1* | 5/2006 | Gano et al. | 166/384 |
| 2006/0272807 | A1* | 12/2006 | Adam et al. | 166/207 |
| 2009/0166040 | A1* | 7/2009 | Cavender et al. | 166/281 |
| 2010/0018305 | A1 | 1/2010 | Maute et al. | |
| 2011/0067890 | A1 | 3/2011 | Themig | |
| 2011/0114336 | A1* | 5/2011 | Lehr et al. | 166/380 |
| 2012/0085549 | A1* | 4/2012 | O'Connor et al. | 166/380 |
| 2012/0103607 | A1 | 5/2012 | Fitzpatrick et al. | |
| 2013/0048308 | A1* | 2/2013 | Lehr et al. | 166/378 |
| 2013/0062055 | A1* | 3/2013 | Tolman et al. | 166/250.01 |
| 2014/0083682 | A1* | 3/2014 | Grigsby et al. | 166/250.01 |
| 2014/0166284 | A1* | 6/2014 | Allen et al. | 166/285 |

OTHER PUBLICATIONS

Mohamed, et al., "One-Trip Installation of 4 ¾ in. Expandable Screen Assembly", SPE/IADC 108262, 2007, 4 pages.

Omar Y. Mohamed et al, "One-Trip Installation of 4 ¾ in. Expandable Screen Assembly", SPE/IADC 108262, 2007, 4 pages.

* cited by examiner

COMPLETION SYSTEM FOR ACCOMODATING LARGER SCREEN ASSEMBLIES

CROSS REFERENCE TO RELATED APPLICATION

This application claims the benefit of an earlier filing date from U.S. Provisional Application Ser. No. 61/739,606 filed Dec. 19, 2012, the entire disclosure of which is incorporated herein by reference.

BACKGROUND

Screen assemblies are ubiquitous in the downhole drilling and completions industry for enabling solids or particulate to be filtered from a flow of fluid, e.g., hydrocarbons, while enabling production of the fluid. Production and stimulation rates through the screen assemblies can be generally increased by increasing the size of the screen assembly. Additionally, it is well established that certain radial clearances between the outer dimension of the screen assembly and the inner dimension of the casing (or other tubular string) in which the screen assembly is positioned must be maintained in order to support stimulation and/or production at appropriate rates. For example, if the radial gap is undesirably small, there is a severe risk of premature screen outs and/or the sand or particulate in a frac or gravel pack bridging off before filling the annulus about a screen assembly. For the above reasons, it is established practice in the industry to use screen assemblies having dimensions that are significantly smaller than the drift diameter of the casing in order to maintain the aforementioned radial clearance in the range of about at least 0.5 inches.

Although maintaining the radial clearance is necessary to support industry accepted production and stimulation rates, it also puts a limit on the maximum possible size of the screen assemblies, which negatively impacts these same rates. The simultaneous use of a larger screen assembly and maintenance of the radial clearance is only possible in these prior systems by using larger casing, but this requires greater material costs and potentially a larger borehole. In view hereof, it is clear that the industry would well receive a system that enables larger screen assemblies to be used within a given size of casing without negatively affecting production and stimulation rates, e.g., by reducing the size of the radial clearance between the screen assembly and the casing to an unacceptable level.

SUMMARY

A method of completing a borehole, including selectively expanding a tubular string having a substantially continuous first dimension to form at least one expanded portion of the tubular string having a second dimension greater than the first dimension and at least one unexpanded portion of the tubular string having the first dimension; and positioning at least one screen assembly radially proximate to the at least one expanded portion for forming an enlarged radial gap between the at least one screen assembly and the expanded portion of the tubular string.

A completion system, including a tubular string having an internal drift dimension and including at least one expanded portion having an expanded internal dimension larger than the internal drift dimension, the tubular string having at least one opening therein formed at the at least one expanded portion; and at least one screen assembly having an outer dimension approximating the internal drift dimension, the at least one screen assembly positioned radially aligned with the at least one expanded portion, wherein the outer dimension and the expanded dimension form a radial clearance therebetween being at least about 0.5 inches.

A method of completing a borehole, including selectively expanding a tubular string having a substantially continuous first dimension to form at least one expanded portion of the tubular string having a second dimension greater than the first dimension and at least one unexpanded portion of the tubular string having the first dimension; and positioning at least one screen assembly radially proximate to the at least one expanded portion for forming an enlarged radial gap between the at least one screen assembly and the expanded portion of the tubular string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
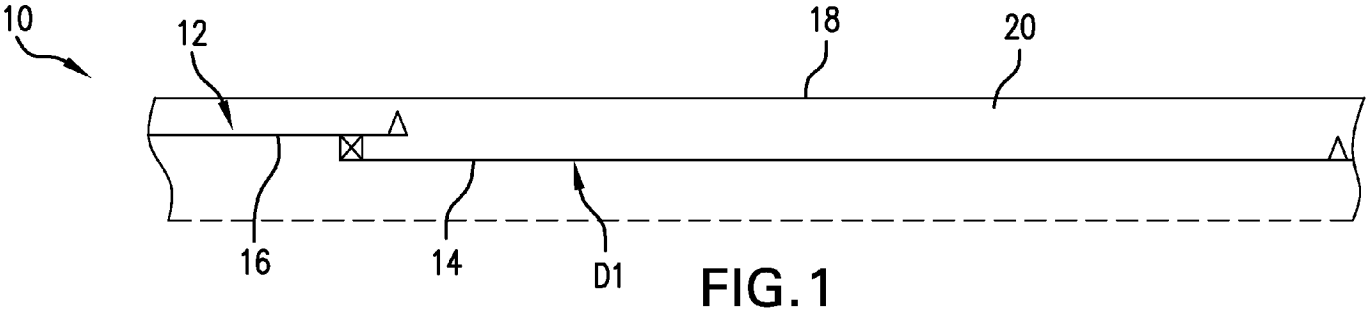
FIG. 1 is a cross-sectional view of a completion system disclosed herein having a liner hung from an upper completion string.
Figure 2:
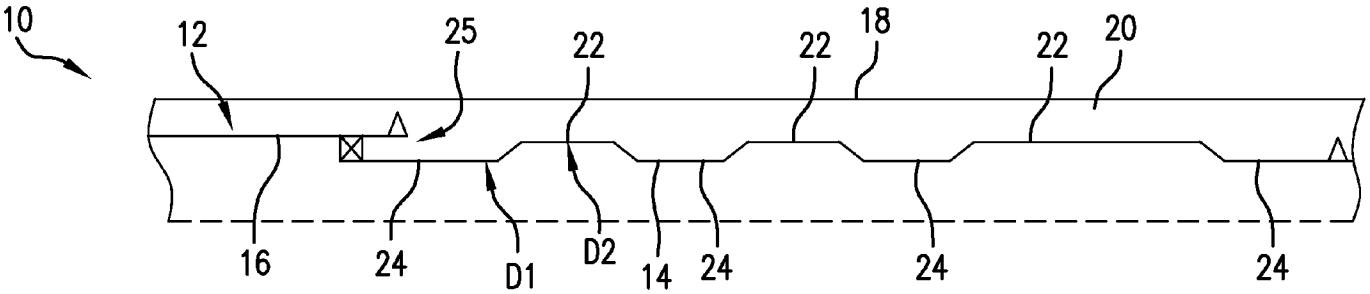
FIG. 2 is a cross-sectional view of the completion system of FIG. 1 being selectively radially expanded to form at least one expanded portion and at least one unexpanded portion.
Figure 3:
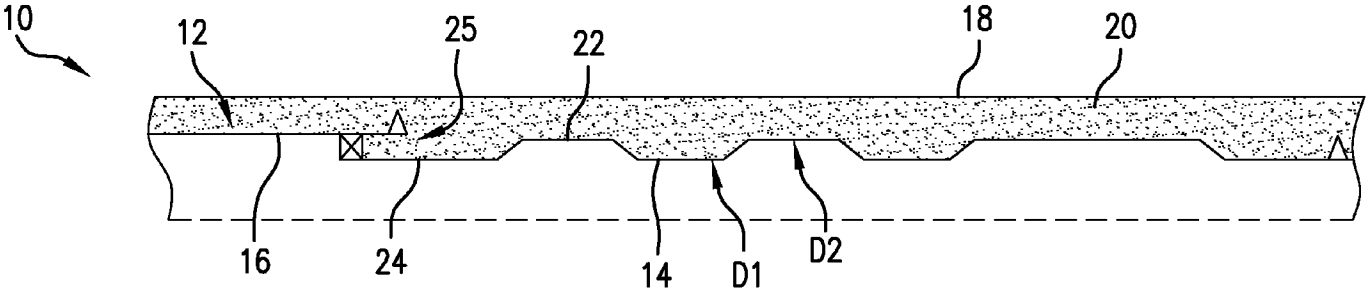
FIG. 3 is a cross-sectional view of the completion system of FIG. 2 having an annulus between a casing and a borehole being cemented.
Figure 4:
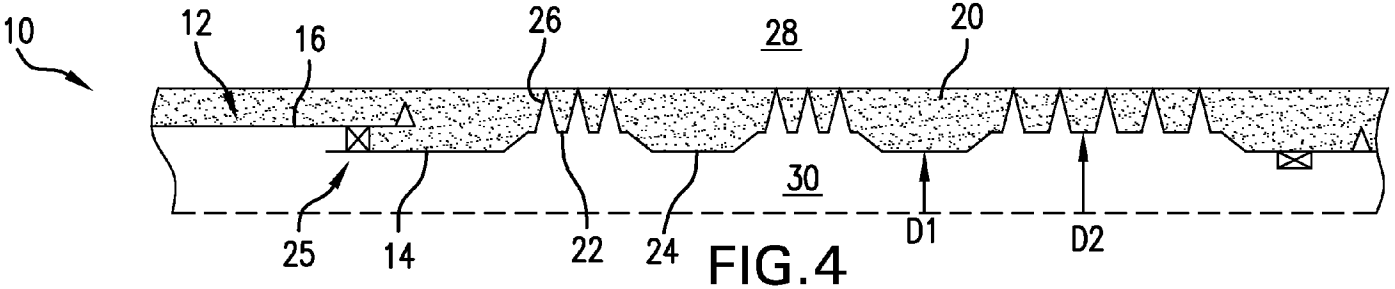
FIG. 4 is a cross-sectional view of the completion system of FIG. 3

Methods for deploying a downhole production system can be best appreciated in view of FIGS. 1-5, in which a completion system 10 is progressively completed. In FIG. 1, a casing 12 or other outer tubular of the completion system 10 comprises a production liner 14 or other tubular string that is hung, anchored, or suspended from an upper casing string 16, which may extend to surface or be a liner or other intermediate casing string. The casing 12 is arranged within a borehole 18, which is drilled and completed according to any suitable method known or discovered in the art. The borehole 18 may include vertical as well as deviated or horizontal portions. An annulus 20 is formed between the casing 12 and the borehole 18. As will be better appreciated in view of the below disclosure, the liner 14 in the illustrated embodiment has a restricted inner diameter in relation to the upper casing string 16, which disadvantageously affects production and stimulation rates. Namely, as discussed in the Background, it is well established that some minimum radial clearance between the casing and any screen assemblies positioned therein must be maintained in order to support production and/or stimulation at acceptable rates.

After arranging the casing 12, e.g., hanging or anchoring the liner 14 from or to the casing string 16, the liner 14 is selectively radially expanded. By selectively expanded, it is meant that portions of the liner 14 are dimensionally enlarged, i.e., plastically deformed, in the radial direction in order to form at least one expanded portion 22 and at least one unexpanded portion 24. In the illustrated embodiment, a plurality of the expanded portions 22 is interspaced with the unexpanded portions 24. The liner 14 has an initial drift dimension (e.g., internal diameter) designated D1, which drift dimension D1 is maintained by the unexpanded portions 24. The expanded portions 22 are radially expanded to an expanded internal dimension (e.g., internal diameter) designated D2, which is greater than the internal drift dimension D1. The term drift dimension or drift diameter is used with its ordinary meaning in the art, namely, relating to the effective or minimum dimension of the liner 14, i.e., such that any component smaller than the drift dimension can be run through the tubular (liner, casing, etc.). In accordance with this understood definition, the drift diameter or dimension D1 may differ slightly from the actual diameter or dimension of the liner 14. In the illustrated embodiment, the internal dimension D2 of the expanded portions 22 is less than the diameter of the casing string 16, while in another embodiment the internal dimension D2 may exceed the internal diameter of the upper casing string 16 or another section of the casing 12.

For the purposes of discussion herein, the term expansion is generally interchangeable with swage, deform, enlarge, and other synonyms thereof. Accordingly, the selective expansion of the casing 12, more specifically of the liner 14 of the casing 12, can be accomplished by any suitable swage, wedge, cone, or other device that is actuatable or transitionable between a retracted or retractable configuration that enables the device to be run through the liner 14 without deforming the unexpanded portions 24 and a radially extended or supported configuration that enables the expanding device to expand the portions 22. The actuation or transition between these two configurations could be provided via any suitable mechanism in any suitable manner, e.g., mechanical, hydraulic, electrical, etc. U.S. Pat. No. 6,352,112 (Mills), which patent is incorporated herein by reference in its entirety, provides an example of a selectively supported swage device that could be adapted for selectively expanding the portions 22 of the liner 14 without expanded the unexpanded portions 24. Those of ordinary skill in the art will recognize that other devices are also suitable for the purpose of selective expansion as described herein. The swaging device could be run into the casing 12 in the same trip as the liner 14, or a separate trip. The swaging could be performed from bottom-up, from top-down, or combinations thereof for each section desired to be swaged.

It is noted that the timing of the swaging process could be different than that described above. For example, in one embodiment, the swaging or expansion of the liner 14 occurs at surface before, or simultaneously with, run-in of the liner 14 as opposed to after it is already set downhole. In one embodiment, the expanded portion is formed by removing wall thickness of the liner 14, such that the outer dimension remains consistent while the dimensions D1 and D2 still differ. Multiple sections of the liner 14 could be coupled together in such an embodiment, e.g., threadedly, to form multiple alternating ones of the portions 22 and 24. In one embodiment, the expanded and unexpanded portions 22 and 24 are each formed from separate components having different dimensions that are affixed together, e.g., threaded, in order to form the liner 14, which is then run-into and secured to the upper casing string 16.

The annulus 20 radially about the casing 12 may be cemented according to any suitable technique, e.g., pumping cement down through the interior of the casing 12 (or another tubular run therewith) and forcing it back up through the annulus 20, thereby filling the annulus 20. In one embodiment the cementation occurs after expanding the portions 22, while in another embodiment, the expansion occurs immediately after pumping the cement before it has a chance to cure and harden. In the illustrated embodiment, a liner lap 25 at the junction between the liner 14 and the casing string 16 is specifically not swaged and forms one of the unexpanded portions 24. Advantageously, not swaging the liner lap 25 during the selective swaging process improves the hydraulic performance of a cement pumping operation that may occur subsequent to the selective swaging process with respect to if the liner lap 25 were also swaged.

After cementation, a perforation gun or other assembly for forming openings in the liner 14 is positioned with respect to the expanded portions 22 in the liner 14 and triggered in order to form a plurality of perforations 26 through the liner 14 and the cement in the annulus 20. Any style of perforating gun could be used and delivered downhole in any desired manner, e.g., coiled tubing, wireline, etc. The perforations 26 provide fluid communication between a downhole formation 28 through which the borehole 18 is formed and an interior passageway 30 of the casing 12. This fluid communication enables fluid, such as hydrocarbons, to be produced from the downhole formation 28 and/or fluid to delivered to the downhole formation 28, e.g., in order to stimulate, fracture, or treat the formation to facilitate later production therefrom (generally, "stimulate"). It is noted that in other embodiments, particularly those in which cementation is not required, that the liner 14 or other portion of the casing 12 could be pre-arranged with perforations or other openings in order to save time and avoid an additional perforation trip.

Once fluid communication is established, an inner string 34, e.g., a production string, can be run including one or more screen assemblies 36. The string 34 and the screen assemblies 36 may resemble a traditional multi-zone frac system or any other system arranged for enabling the stimulation of and/or production from a downhole formation. In the illustrated embodiment, one of the screen assemblies 36 is provided for each of the expanded portions 22, which may in turn be associated individually with production zones. A packer 38 or other seal device is arranged on the inner string 34 and arranged to engage against each unexpanded portion 24 in order to isolate the screen assemblies 36 and/or their corresponding zones from each other. The screen assemblies 36 are arranged with a filter or mesh 40, e.g., wire wrap screen, narrow slots, permeable foam, etc., in order to impede the passage of solids, e.g., sand, therethrough while permitting fluid flow. The screen assemblies 36 can each be provided with a first valve 42 arranged for enabling selective fluid communication directly with the formation 28 (bypassing the filter or mesh 40), e.g., in order perform a treatment, stimulation, fracturing, or other operation on the formation 28, and a second valve 44 arranged for enabling selective fluid communication through the mesh or filter 40 of the screen assemblies 36, e.g., in order to produce fluid from the formation 28 as well as create a circulation flow path for a gravel or frac pack or other stimulation or treatment operation. The valves 42 and 44 can be opened and/or closed due to hydraulic pressure, engagement with a shifting tool, a dropped plug or ball, or in any other desired manner or combinations thereof.

Figure 5:
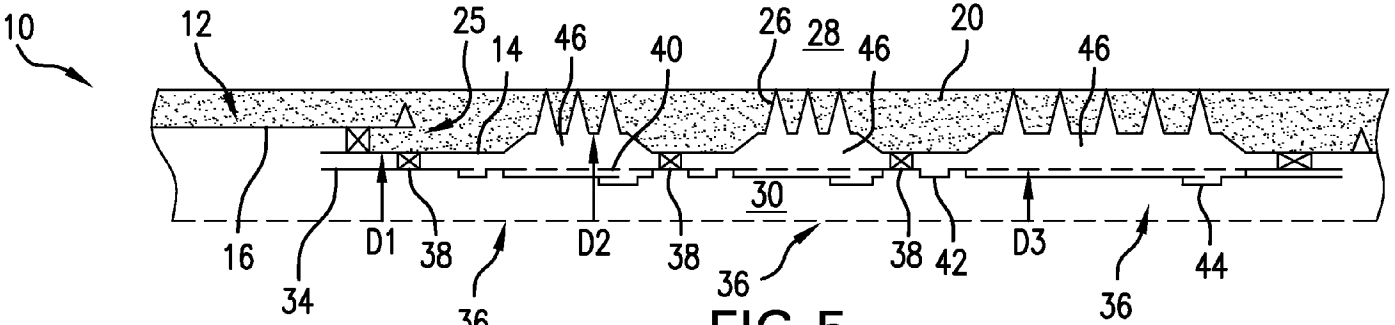
FIG. 5 is a cross-sectional view of the completion system of FIG. 4 having a screen assembly positioned radially proximate each of the expanded portions for forming an enlarged radial gap between the screen assembly and the corresponding expanded portion.

As noted above, fluid production and stimulation rates of a downhole completion are limited by the size, e.g., diameter, of the screen assemblies used. That is, smaller screens are associated with smaller base pipes and/or production strings having relatively restricted internal flow passages therethrough, which restricts fluid flow for production and stimulation. Furthermore, a minimum radial clearance, as noted above, between the outside of the screen assembly and the inner drift dimension of the casing must be maintained in order to support acceptable stimulation and/or production rates. Advantageously, with specific reference to the system 10, the swaging of the portions 22 of the liner 14 at which the screen assemblies 36 are positioned, enables the outer dimension (e.g., outer diameter) of the screen assemblies, designated D3 in FIG. 5, to approximate or approach the internal drift diameter D1 of the liner 14 and the unexpanded portions 24, while still providing the required radial clearance between the screen assemblies and the casing. By the outer dimension D3 "approximating" the internal dimension D1 it is not meant that the outer dimension D3 is some arbitrary amount from the internal dimension D1, but is rather meant that the outer dimension D3 is either at or sufficiently close to the drift dimension D1 so that the aforementioned necessary minimum radial clearance between the screen assemblies 36 and the liner 14 cannot maintained. However, the dimensions D1 and D3 may differ slightly, e.g., due to manufacturing tolerances, to accommodate seal elements (e.g., the packers 38), to facilitate run-in of the screen assemblies 36, etc. In accordance to the above, a gap or clearance 46 is shown in FIG. 5, formed as the difference between the dimension D3 of the screen assemblies 36 and the dimension D2 of the expanded portions 22. It is to be appreciated that the Figures are not shown proportionally and that the clearance 46 may be several times or even orders of magnitude larger than the difference between the dimensions D1 and D3. By the dimension D3 of the screen assemblies 36 approximating the dimension D1, the necessary radial clearance 46 between the screen assemblies 36 and the unexpanded portions 24 of the liner 14 is not be maintained, and acceptable production and stimulation rates are only supported by positioning the screen assemblies 36 radially proximate to the expanded portions 22. In one embodiment, the radial clearance 46 is about at least 0.5 inches, as radial clearances of significantly smaller sizes are not typically tolerated in the downhole industry.

Figure 6:
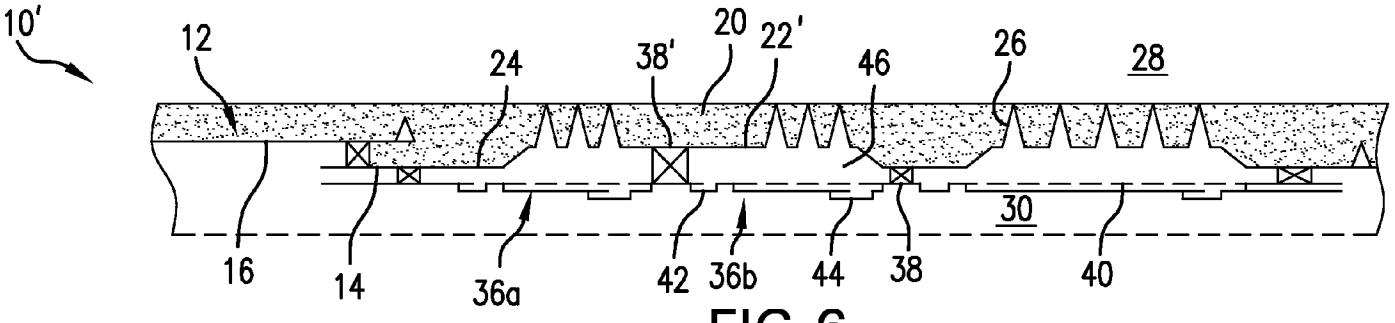
FIG. 6 is a cross-sectional view of an alternate embodiment disclosed herein wherein an expanded portion corresponds to multiple screen assemblies.

An alternate embodiment, designated as a system 10', is shown in FIG. 6. In this embodiment, the liner 14 is swaged such that two zones or areas are associated with the same swaged portion, designated as a swaged portion 22'. In such an embodiment, if isolation is desired between adjacent screen assemblies, e.g., screen assemblies 36*a* and 36*b*, then a packer 38' is required that is larger than the packers 38. For example, the packer 38' could be swellable in response to a fluid such as water or oil, inflatable, radially extendable due to axial compression or removal of a retaining band, etc., in order to transition from a first size suitable to bypass the unexpanded portions 24 and yet still be able to engage with the expanded portion 22'.

In view of the foregoing, it is to be appreciated that the current invention is particularly advantageous for gravel and frac pack systems, and other systems for which the industry mandates a sufficient radial clearance (e.g., about half an inch or larger) between the screen assemblies and the outer tubular or casing housing the screen assemblies. Even more particularly to systems similar to those illustrated in which screen assemblies are positioned in a relatively smaller dimensioned string, e.g., the liner 14, which is hung or suspended from a relatively larger dimensioned upper string, e.g., the upper casing 16. That is, the relatively smaller dimensioned string, e.g., the liner 14, in which the screen assemblies are placed would typically result in either the size of the screen assemblies to be reduced or that of the radial gap between the screen assemblies and the inner surface of the casing, but this issue is avoided by the current invention. It is also to be understood that although the current invention is particularly advantageous in such situations, the casing or other outer tubular string may not have a relatively smaller dimensioned string hung from a relatively larger outer dimensioned string. Even in this embodiment, the overall dimension of the casing or outer tubular can be reduced, thereby saving material costs, while still producing at the same rate as a traditional system having a larger outer dimension. That is, the size of the casing or outer tubular only needs to be set as just large enough for the screen assemblies to be located therein without need to accommodate for the radial gap between the screen assemblies and inner dimension of the casing, as the desired radial gap is achieved by the above-described swaging process.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A completion system, comprising:

a tubular string initially having an substantially constant first dimension and configured to include at least one unexpanded portion having the first dimension and a plurality of expanded portions having a second dimension larger than the first dimension with one of the at least one unexpanded portions interspaced between adjacent ones of the expanded portions, the tubular string having at least one opening therein formed at the at least one expanded portion;

at least one screen assembly having a third dimension and positioned radially adjacent the at least one expanded portion; and a radial clearance between the outer dimension of the at least one screen assembly and the second internal dimension of the at least one second portion of the outer tubular string.

2. The completion system of claim 1, wherein the tubular string is part of a casing for a borehole.

3. The completion system of claim 2, wherein the tubular string is a liner hung from an upper casing string.

4. The completion system of claim 3, wherein the second dimension of the expanded portion exceeds a fourth dimension of the upper casing string.

5. The completion system of claim 3, further comprising an annulus between the borehole and the tubular string that is filled with cement.

6. The completion system of claim 5, wherein a liner lap of the liner between the liner and the upper casing string forms at least one of the at least one unexpanded portions of the liner.

7. The completion system of claim 1, wherein the at least one screen assembly is run-in on an inner tubular string.

8. The completion system of claim 7, wherein the inner tubular string includes at least one packer corresponding to the at least one unexpanded portion and engaged against the at least one unexpanded portion when the at least one screen assembly is positioned proximate to the at least one expanded portion.

9. The completion system of claim 8, wherein the at least one packer isolates the at least one screen assembly.

10. The completion system of claim 1, wherein the at least one opening is formed as a plurality of perforations.

11. The completion system of claim 1, wherein the radial clearance is at least about 0.5 inches.

12. A method of completing a borehole, comprising:

selectively expanding a tubular string having a substantially continuous first dimension to form a plurality of expanded portions of the tubular string having a second dimension greater than the first dimension and at least one unexpanded portion of the tubular string having the first dimension and interspersed between adjacent ones of the expanded portions; and positioning at least one screen assembly radially proximate to the at least one expanded portion for forming an enlarged radial gap between the at least one screen assembly and the expanded portion of the tubular string.

13. The method of claim 12, further comprising perforating the at least one expanded portion.

14. The method of claim 13, wherein perforating occurs after selectively expanding.

15. The method of claim 12, wherein the tubular string is anchored to a second string having a second dimension larger than the first dimension.

16. The method of claim 12, further comprising cementing an annulus located between the tubular string and the borehole by pumping a cement down through an inner passageway of the completion system and back up through the annulus.

17. The method of claim 16, wherein the tubular string comprises a liner hung from an upper casing string and a liner lap of the liner between the liner and the upper casing string forms at least one of the at least one unexpanded portions.

* * * * *